US010125760B2

(12) United States Patent
Tanaka

(10) Patent No.: US 10,125,760 B2
(45) Date of Patent: Nov. 13, 2018

(54) PUMP

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/835,786

(22) Filed: Dec. 8, 2017

(65) Prior Publication Data

US 2018/0100495 A1 Apr. 12, 2018

Related U.S. Application Data

(63) Continuation of application No. PCT/JP2016/066106, filed on Jun. 1, 2016.

(30) Foreign Application Priority Data

Jun. 11, 2015 (JP) ..... 2015-118260

(51) Int. Cl.
*F04B 45/04* (2006.01)
*F04B 45/047* (2006.01)
(Continued)

(52) U.S. Cl.
CPC ..... *F04B 45/047* (2013.01); *F04B 43/02* (2013.01); *F04B 43/04* (2013.01); *F04B 45/04* (2013.01);
(Continued)

(58) Field of Classification Search
CPC .... F04B 43/046; F04B 45/045; F04B 45/047; F04F 7/00
See application file for complete search history.

(56) References Cited

U.S. PATENT DOCUMENTS 9,109,592 B2 * 8/2015 Fujisaki ..... F04B 45/047
9,127,665 B2 * 9/2015 Locke ..... F04B 43/023
(Continued)

FOREIGN PATENT DOCUMENTS

CN 101469692 A 7/2009
JP 2005-90510 A 4/2005
(Continued)

OTHER PUBLICATIONS

International Search Report for PCT/JP2016/066106 dated Aug. 23, 2016.
Written Opinion for PCT/JP2016/066106 dated Aug. 23, 2016.

*Primary Examiner* — Patrick Hamo
(74) *Attorney, Agent, or Firm* — Pearne & Gordon LLP

(57) ABSTRACT

A pump includes a pressure chamber that generates pressure oscillation occurring from the center of the pressure chamber to an outer peripheral portion of the pressure chamber when viewed in plan view in a thickness direction. The pump includes a vibrating plate portion that faces the pressure chamber in the thickness direction and that is displaced in the thickness direction and a top plate portion that faces the pressure chamber in a direction opposite to the direction in which the vibrating plate portion faces the pressure chamber. The vibrating plate portion has a first inlet port that is open at the outer peripheral portion of the pressure chamber. The top plate portion has an outlet port that is open at a center portion of the pressure chamber and a second inlet port that is open at the outer peripheral portion of the pressure chamber.

9 Claims, 7 Drawing Sheets

(51) Int. Cl.

| | |
|---|---|
| ***F04B 43/02*** | (2006.01) |
| ***F04B 43/04*** | (2006.01) |
| ***F04D 33/00*** | (2006.01) |
| *F04B 43/00* | (2006.01) |

(52) U.S. Cl.
CPC ..... *F04D 33/00* (2013.01); *F04B 43/0027* (2013.01); *F04B 45/045* (2013.01)

(56) References Cited

U.S. PATENT DOCUMENTS

| | | | | |
|---|---|---|---|---|
| 9,151,284 | B2 * | 10/2015 | Hirata | F04B 45/047 |
| 9,217,426 | B2 * | 12/2015 | Wackerle | F04B 43/04 |
| 9,506,463 | B2 * | 11/2016 | Locke | F04B 43/046 |
| 2005/0089415 | A1 | 4/2005 | Cho | |
| 2009/0087323 | A1 | 4/2009 | Blakey et al. | |
| 2009/0167109 | A1 | 7/2009 | Tomita | |
| 2013/0071273 | A1 * | 3/2013 | Locke | F04B 43/046<br>417/480 |
| 2015/0150470 | A1 | 6/2015 | Sano | |

FOREIGN PATENT DOCUMENTS

| | | | |
|---|---|---|---|
| JP | 2009-250132 | A | 10/2009 |
| JP | 4795428 | B2 | 10/2011 |
| JP | 2013-245649 | A | 12/2013 |
| WO | 2014/024608 | A1 | 2/2014 |

* cited by examiner

PUMP

This is a continuation of International Application No. PCT/JP2016/066106 filed on Jun. 1, 2016 which claims priority from Japanese Patent Application No. 2015-118260 filed on Jun. 11, 2015. The contents of these applications are incorporated herein by reference in their entireties.

BACKGROUND OF THE DISCLOSURE

Field of the Disclosure

The present disclosure relates to a pump that transports a fluid.

Description of the Related Art

In the related art, there is known a pump having a multilayer structure (see, for example, Patent Document 1). This pump includes a pressure chamber, in which an inlet port that allows a fluid to flow into the pressure chamber and an outlet port that allows the fluid to flow out from the pressure chamber are formed, a diaphragm that is disposed so as to face the pressure chamber, and a piezoelectric element that causes the diaphragm to vibrate.

The pump is configured such that a node and an anti-node of pressure oscillation are generated in the pressure chamber. In the pressure chamber, the inlet port is formed so as to be open at a position corresponding to the node of pressure oscillation. In the pressure chamber, the outlet port is formed so as to be open at a position corresponding to the anti-node of pressure oscillation. As a result, the pump disclosed in Patent Document 1 causes the pressure chamber to perform pressure oscillation in an ideal state, so that discharge performances such as a discharge pressure and a discharge flow rate are improved.

Patent Document 1: Japanese Patent No. 4795428

BRIEF SUMMARY OF THE DISCLOSURE

However, in such a pump that is disclosed in Patent Document 1, in the case where the diameter of an inlet port is small, there is a problem in that the flow path resistance at the inlet port is large, so that the viscosity loss is increased, which in turn results in a decrease in power efficiency. On the other hand, in the case where the diameter of the inlet port is large, it is difficult to open the inlet port only at a node of pressure oscillation, and pressure oscillation of a pressure chamber differs from an ideal state. Consequently, in the pump disclosed in Patent Document 1, in both cases where the diameter of the inlet port is too large and where the diameter of the inlet port is too small, discharge performances such as a discharge pressure and a discharge flow rate deteriorate.

Accordingly, it is an object of the present disclosure to provide a pump capable of reducing the viscosity loss at an inlet port without increasing the size of the inlet port and capable of further improving its discharge performance than that in the related art.

The present disclosure provides a pump that includes a pressure chamber that generates pressure oscillation occurring from the center of the pressure chamber to an outer peripheral portion of the pressure chamber when viewed in plan view in a thickness direction, the pump including a vibrating plate portion that faces the pressure chamber in the thickness direction and that is displaced in the thickness direction and a top plate portion that faces the pressure chamber in a direction opposite to the direction in which the vibrating plate portion faces the pressure chamber. The vibrating plate portion has a first inlet port that is open at the outer peripheral portion of the pressure chamber, and the top plate portion has an outlet port that is open at a center portion of the pressure chamber and a second inlet port that is open at the outer peripheral portion of the pressure chamber.

In this configuration, when a region (hereinafter referred to as a diaphragm) of the vibrating plate portion near the center of the vibrating plate portion is displaced in the thickness direction, a fluid is drawn into the pressure chamber through both of the first inlet port and the second inlet port, and the fluid is discharged from the pressure chamber through the outlet port. Thus, even if the size of each of the first inlet port and the second inlet port is small, the total flow rate of the fluid flowing through the first inlet port and the fluid flowing through the second inlet port can be large, and the flow path resistance at each of the first inlet port and the second inlet port can be reduced, so that viscosity loss can be reduced. As a result, in the pump, discharge performance better than that in the related art can be obtained.

It is preferable that the following formula be satisfied when a, f, c, and $K_0$ respectively stand for one of a dimension from the center of the top plate portion to the second inlet port and a dimension from the center of the vibrating plate portion to the first inlet port, the one of the dimensions being smaller than another one of the dimensions, a resonant frequency of the vibrating plate portion, an acoustic velocity of a fluid that passes through the pressure chamber, and a value that satisfies the Bessel function of the first kind $J_0(k_0)=0$.

$$0.8\times\frac{k_0c}{2\pi}<a*f<1.2\times\frac{k_0c}{2\pi} \quad \text{[Math. 1]}$$

In particular, it is preferable that the dimension a and the drive frequency f satisfy the following formula.

$$0.9\times\frac{k_0c}{2\pi}<a*f<1.1\times\frac{k_0c}{2\pi} \quad \text{[Math. 2]}$$

In these configurations, in the pressure chamber, a node of pressure oscillation can be generated in the vicinity of a position at which one of the first and second inlet ports, the one being positioned further inside than the other, is open. Here, when the following formula is satisfied, in the pressure chamber, an ideal state (resonant state) of pressure oscillation in which an anti-node of the pressure oscillation is generated in the vicinity of the outlet port and in which a node of the oscillation is generated in the vicinity of the first outlet port or in the vicinity of the second outlet port can be obtained.

$$a*f=\frac{k_0c}{2\pi} \quad \text{[Math. 3]}$$

Therefore, also in the case where the relationship of [Math. 1] or the relationship of [Math. 2] is satisfied, a quasi-ideal state of pressure oscillation can be obtained, and favorable discharge performance can be obtained.

It is preferable that the dimension from the center of the top plate portion to the second inlet port be smaller than the dimension from the center of the vibrating plate portion to the first inlet port.

In this configuration, the distance from the center of the pressure chamber to the node of the pressure oscillation can be reduced without reducing the radius of the diaphragm. In the top plate portion, if the second inlet port is provided at a position further inside than the first inlet port, the distance from the center of the pressure chamber to the node of the pressure oscillation becomes smaller than the radius of the diaphragm. The smaller the distance from the center of the pressure chamber to the node of the pressure oscillation, the higher the resonant frequency (hereinafter referred to as resonance frequency) of pressure oscillation in the pressure chamber, that is, the operating sound of the pump becomes a high-pitched sound which is less audible to a person. However, the resonance frequency in the pressure chamber can be increased also by reducing the size of the diaphragm or the size of the piezoelectric element. In this case, however, the amplitude of vibration of the diaphragm decreases, and the discharge performance deteriorates. In contrast, in the above-described configuration, even if the resonance frequency is set to be high, it is not necessary to reduce the size of the diaphragm or the size of the piezoelectric element, and thus, the operating sound of the pump can be made less audible to a person without a deterioration in the discharge performance of the pump.

It is preferable that the second inlet port extend in the lateral direction perpendicular to the thickness direction of the top plate portion and communicate with the outside.

In this configuration, the rigidity of the top plate portion can be improved, and the probability of occurrence of a problem such as damage to the top plate portion can be reduced.

According to the pump of the present disclosure, the viscosity loss that occurs at each of the first inlet port and the second inlet port can be reduced, and as a result, discharge performance better than that in the related art can be obtained.

DETAILED DESCRIPTION OF THE DISCLOSURE

Pumps according to a plurality of embodiments of the present disclosure will be described below by providing a pump that is configured to draw in and discharge a gas as an example. Note that the pump according to the present disclosure can be configured to control the flow of a suitable fluid, such as a liquid, a gas-liquid mixed fluid, a gas-solid mixed fluid, a solid-liquid mixed fluid, a gel, and a gel mixed fluid, other than a gas.

First Embodiment

Figure 1:
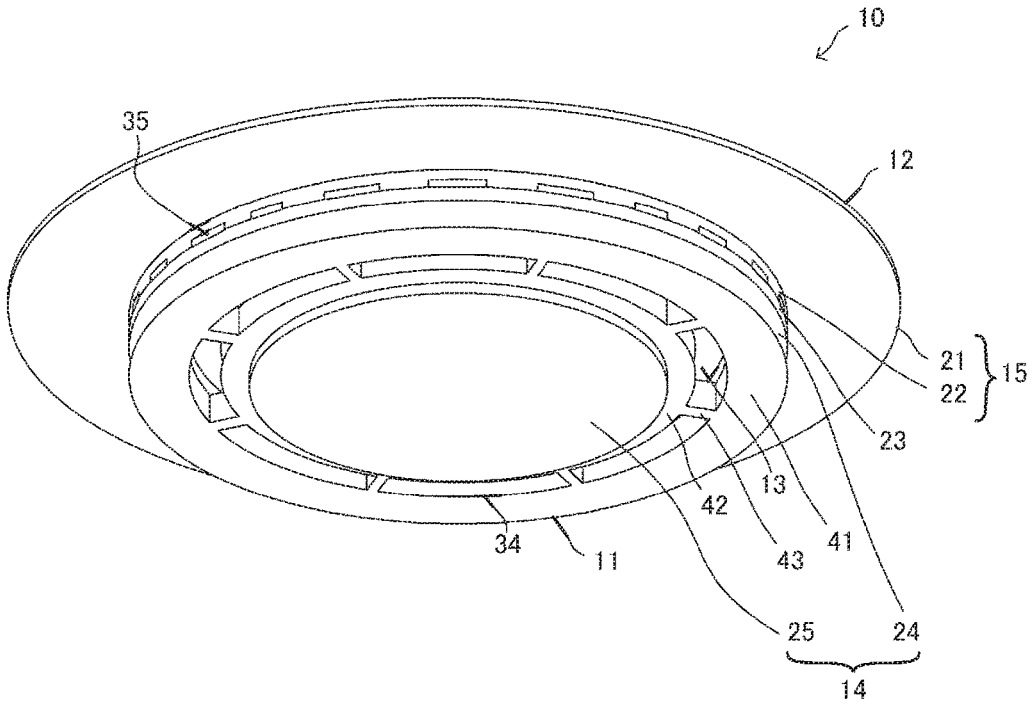
FIG. 1 is an external perspective view of a pump according to a first embodiment of the present disclosure when viewed from the bottom surface side of the pump.
Figure 2:
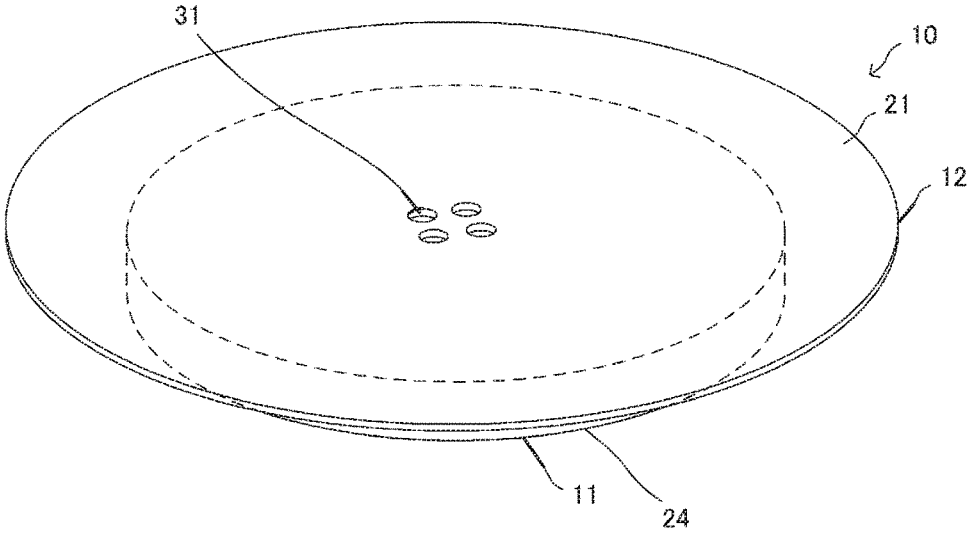
FIG. 2 is an external perspective view of the pump according to the first embodiment of the present disclosure when viewed from the top surface side of the pump.
Figure 3:
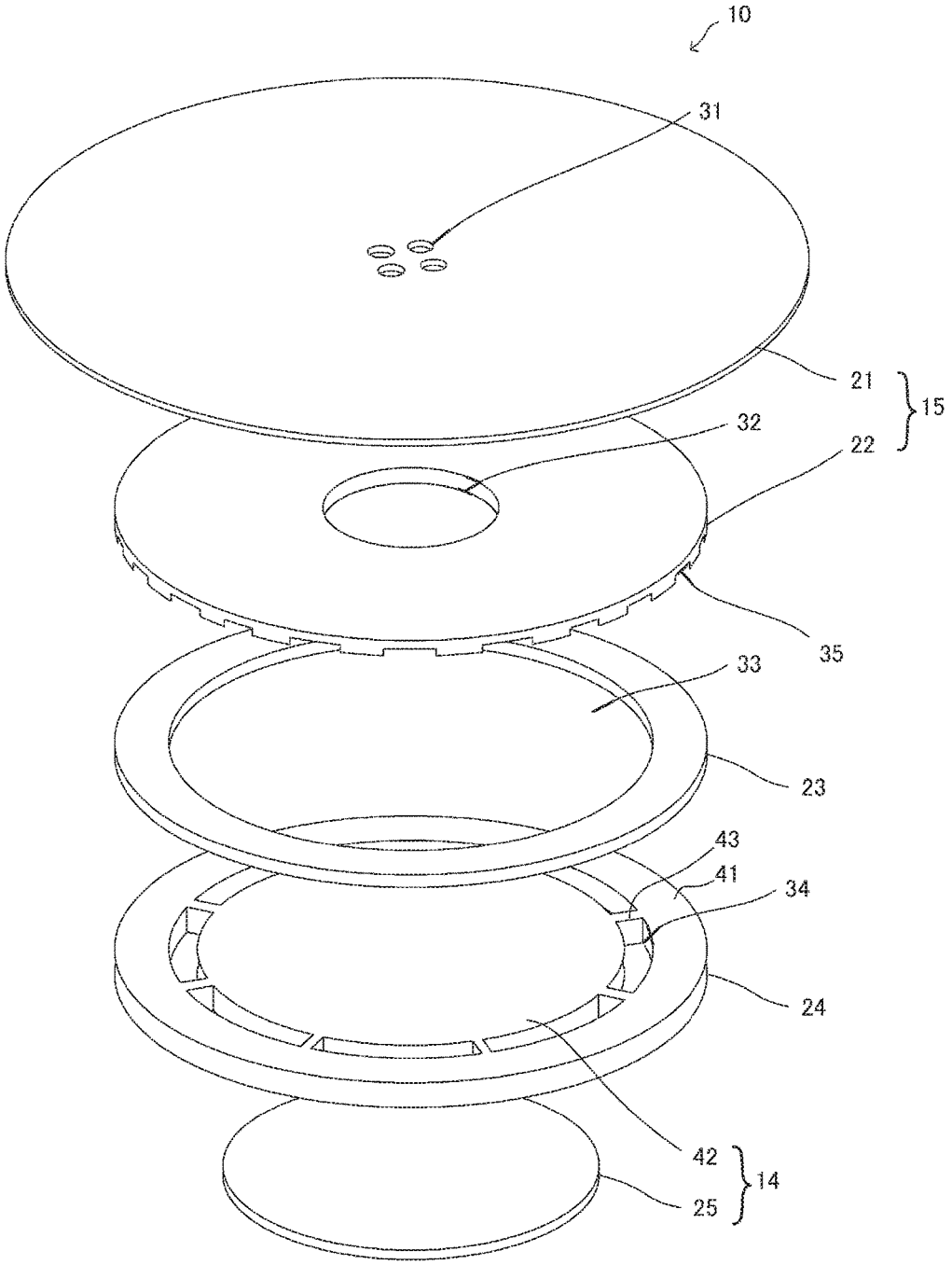
FIG. 3 is an exploded perspective view of the pump according to the first embodiment of the present disclosure.

FIG. 1 is an external perspective view of a pump 10 according to a first embodiment of the present disclosure when viewed from the bottom surface side of the pump 10. FIG. 2 is an external perspective view of the pump 10 when viewed from the top surface side of the pump 10. FIG. 3 is an exploded perspective view of the pump 10 when viewed from the top surface side of the pump 10.

The pump 10 includes a main body portion 11 and a projecting portion 12. The main body portion 11 is a columnar portion having a top surface, a bottom surface, and a circumferential surface. In the following description, a direction connecting the top surface and the bottom surface corresponds to the thickness direction of the pump 10. The projecting portion 12 is a ring-shaped portion that is provided at an end portion of the main body portion 11 on the top surface side of the main body portion 11 and that projects from the main body portion 11 in a radial direction. The pump 10 includes a pressure chamber 13 formed in the main body portion 11.

As illustrated in FIG. 3, the pump 10 is formed of a thin top plate 21, a thick top plate 22, a side wall plate 23, a vibrating plate 24, and a piezoelectric element 25 laminated together in this order in a direction from the top surface side toward the bottom surface side. Note that a multilayer body formed of the thin top plate 21 and the thick top plate 22 forms a top plate portion 15. A multilayer body formed of the vibrating plate 24 and the piezoelectric element 25 forms a vibrating plate portion 14.

The thin top plate 21 has a circular plate-like shape and forms the top surface of the main body portion 11 and the projecting portion 12. When the thin top plate 21 is viewed in plan view, outlet ports 31 are formed in the vicinity of the center of the thin top plate 21. Here, the plurality of (four) outlet ports 31 are locally and collectively arranged. The outlet ports 31 communicate with the external space on the top surface side of the main body portion 11 and with the pressure chamber 13 formed in the main body portion 11 and allows a gas to flow out from the pressure chamber 13 to the outside.

Figure 4:
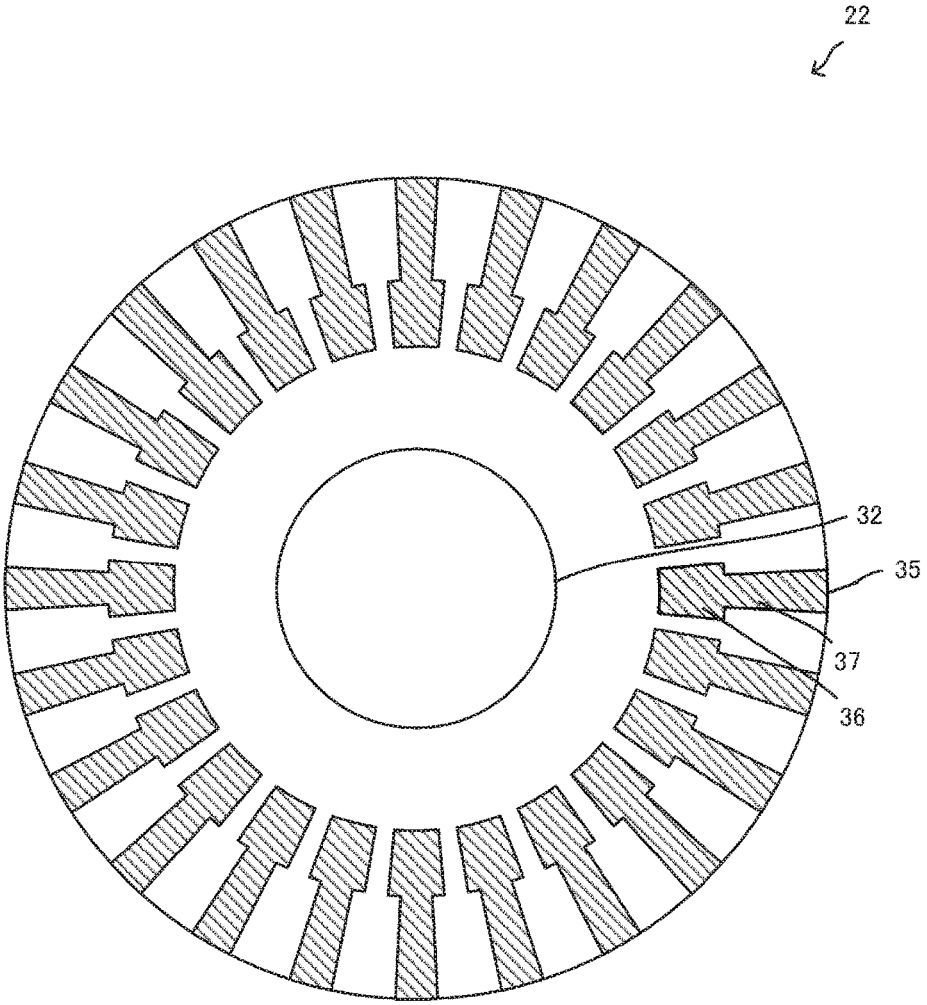
FIG. 4 is a plan view of a top plate portion included in the pump according to the first embodiment of the present disclosure when viewed from the bottom surface side of the top plate portion.

The thick top plate 22 forms a part of the main body portion 11 and has a ring-like shape whose outer diameter is smaller than that of the thin top plate 21. FIG. 4 is a plan view of the thick top plate 22 when viewed from the bottom surface side. The thick top plate 22 has a cavity 32 that forms a part of the pressure chamber 13 and a plurality of second inlet ports 35. The cavity 32 is formed at the center of the thick top plate 22 when viewed in plan view. Each of the plurality of second inlet ports 35 is formed in the bottom surface of the thick top plate 22 so as to have a groove shape and radially extends from a position spaced apart from the cavity 32 toward the outer peripheral side.

The cavity 32 is in communication with the above-mentioned outlet ports 31 of the thin top plate 21 and a cavity 33 of the side wall plate 23, which will be described later, and has an opening diameter smaller than that of the cavity 33 of the side wall plate 23, which will be described later. By positioning the cavity 32 having such an opening diameter between the cavity 33 of the side wall plate 23 and the outlet ports 31 of the thin top plate 21, generation of a vortex flow of a fluid at a portion in which the outlet ports 31 and the pressure chamber 13 communicate with each other can be suppressed. In other words, the fluid can flow in a laminar flow state, and the fluid can easily flow.

Each of the plurality of second inlet ports 35 has a groove shape extending to the outer periphery of the thick top plate 22 from a position closer to the center than the cavity 33 of the side wall plate 23 (described later) is. Each of the second inlet ports 35 has a larger width portion 36 positioned at one end thereof on the center side and a smaller width portion 37 positioned at the other end thereof on the outer periphery side. Each of the larger width portions 36 has a shape whose width is larger than that of a corresponding one of the smaller width portions 37 when viewed in plan view. The larger width portions 36 are located inside the cavity 33 of the side wall plate 23, which will be described later, that is, the entirety of each of the larger width portions 36 is exposed to the pressure chamber 13. The smaller width portions 37 are superposed with the side wall plate 23, which will be described later, and communicate with the outside at the outer periphery end of the thick top plate 22 so as to allow the gas to flow into the pressure chamber 13 from the outside. As a result of the second inlet ports 35 including the larger width portions 36, the flow of the fluid can be brought close to a laminar flow state at an end on the side on which the pressure chamber 13 is present, and the flow path resistance at the second inlet ports 35 can be reduced, so that the fluid can easily flow. In addition, as a result of the second inlet ports 35 including the smaller width portion 37, the area in which the thick top plate 22 and the side wall plate 23, which will be described below, are joined together can be increased, and a larger interface strength between the thick top plate 22 and the side wall plate 23 can be ensured.

The side wall plate 23 illustrated in FIG. 3 forms a part of the main body portion 11 and is formed in a ring-like shape having the same outer diameter as that of the thick top plate 22 and having the cavity 33 whose opening diameter is larger than that of the cavity 32 of the thick top plate 22. The cavity 33 forms a part of the pressure chamber 13 and is formed at the center of the thick top plate 22 when viewed in plan view.

The vibrating plate 24 includes a frame portion 41, a diaphragm 42, and connecting portions 43. The diaphragm 42 has a circular plate-like shape. The frame portion 41 has a ring-like shape surrounding the diaphragm 42 with an interval therebetween and has the same outer diameter and opening diameter as those of the side wall plate 23. The frame portion 41 is joined to the bottom surface of the side wall plate 23. Each of the connecting portions 43 is in the form of a beam extending in a radial direction from the diaphragm 42 so as to connect the diaphragm 42 and the frame portion 41 to each other. As a result, the diaphragm 42 is elastically supported on the frame portion 41 via the connecting portions 43. When the vibrating plate 24 is viewed in plan view, first inlet ports 34 are formed in regions defined by the frame portion 41, the diaphragm 42, and the connecting portions 43. The first inlet ports 34 communicate with the external space on the bottom surface side of the main body portion 11 and with the pressure chamber 13 formed in the main body portion 11 and allows the gas to flow into the pressure chamber 13 from the outside.

The piezoelectric element 25 has a circular plate-like shape and is attached to the bottom surface of the diaphragm 42. The piezoelectric element 25 is formed by disposing electrodes (not illustrated) on the top surface and the bottom surface of a circular plate made of a piezoelectric material such as a PZT-based ceramic. Note that the vibrating plate 24 made of a metal may serve as an alternative to the electrode on the top surface of the piezoelectric element 25. The piezoelectric element 25 has piezoelectricity such that the area thereof increases or decreases in the in-plane direction as a result of an electric field oriented in the thickness direction being applied thereto. By employing the piezoelectric element 25 such as that described above, the vibrating plate portion 14, which will be described later, can be formed so as to be thin. Note that the piezoelectric element 25 may be attached to the top surface of the diaphragm 42, or a total of two piezoelectric elements 25, each of which is attached to a corresponding one of the top surface and the bottom surface of the diaphragm 42, may be provided.

Figure 5:
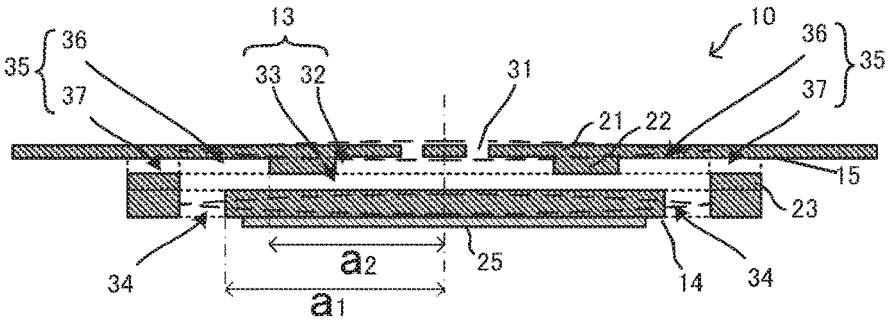
FIG. 5 is a cross-sectional side view of the pump according to the first embodiment of the present disclosure.

FIG. 5 is a cross-sectional side view of the pump 10. The side wall plate 23 is sandwiched between the vibrating plate portion 14 and the top plate portion 15 in the thickness direction, so that the pressure chamber 13 having a substantially columnar shape is formed in the pump 10. The pressure chamber 13 is formed of the cavity 32 formed in the top plate portion 15 and the cavity 33 formed in the side wall plate 23. The pressure chamber 13 communicates with the outside via the first inlet ports 34 formed in the vibrating plate portion 14, the second inlet ports 35 formed in the top plate portion 15, and the outlet ports 31 formed in the top plate portion 15.

When the pump 10 is driven, an alternating-current (AC) driving signal is applied to the piezoelectric element 25. As a result of the AC driving signal being applied to the piezoelectric element 25, area oscillation occurs such that the area of the piezoelectric element 25 increases or decreases. This area oscillation of the piezoelectric element 25 is restrained by the diaphragm 42, so that concentric circular flexural vibration occurs in the vibrating plate portion 14 in the thickness direction.

Vibration of the vibrating plate portion 14 is transmitted to the thick top plate 22 and the thin top plate 21 via the frame portion 41 and the side wall plate 23 or via fluid pressure fluctuations in the pressure chamber 13. As a result, flexural vibration occurs in a region of the thin top plate 21, the region facing the cavity 32 of the thick top plate 22, in the thickness direction. The vibration that occurs in the thin top plate 21 and the vibration that occurs in the vibrating plate portion 14 have the same frequency and a fixed phase difference.

As a result of these vibrations being generated in a coupled manner, the dimension of the pressure chamber 13 in the thickness direction changes in the form of a progressive wave travelling inwardly in the radial direction of the pressure chamber 13. This generates, in the pressure chamber 13, the flow of the fluid toward the inside in the radial direction and the fluid is drawn in through the first inlet ports 34 and the second inlet ports 35 and discharged from the outlet ports 31.

Since the pump 10 has not only the first inlet ports 34 but also the second inlet ports 35, even if the size of each of the first inlet ports 34 is small, the total flow rate of the fluid flowing through the first inlet ports 34 and the fluid flowing through the second inlet ports 35 can be large, and the flow path resistance at each of the first inlet ports 34 and at each of the second inlet ports 35 can be reduced. Therefore, the viscosity loss of the fluid can be reduced without increasing the size of each of the first inlet ports 34, and the pump 10 can obtain discharge performance better than that in the related art.

Pressure oscillation acts on the fluid flowing in the pressure chamber 13 at each point from the center of the pressure chamber 13 to the outer peripheral portion of the pressure chamber 13. This pressure oscillation is brought into a resonant state when the distance from the center of the pressure chamber 13 to the first inlet ports 34, the distance from the center of the pressure chamber 13 to the second inlet ports 35, the resonant frequency of the vibrating plate portion 14, and the like satisfy specific conditions, and the amplitude near the center of the pressure chamber 13 becomes maximum. Here, the resonant state of pressure oscillation is a state in which pressure oscillation occurred on the center side of the pressure chamber 13 and pressure oscillation that is the pressure oscillation that has propagated to the side on which the outer peripheral portion is present and that has been reflected so as to propagate back to the center side of the pressure chamber 13, overlap each other such that an oscillation anti-node is formed near the center of the pressure chamber 13 and an oscillation node is formed in the vicinity of the outer peripheral portion of the pressure chamber 13.

In the present embodiment, a dimension a2 from the center of the pressure chamber 13 to the second inlet ports 35 in the radial direction is set to be smaller than a dimension a1 from the center of the pressure chamber 13 to the first inlet ports 34 in the radial direction. In this case, conditions under which pressure oscillation is brought into an ideal resonant state can be expressed by the following formula.

$$a_2 f = \frac{k_0 c}{2\pi} \quad \text{[Math. 4]}$$

In [Math. 4], f, c, and $K_0$ respectively stand for the drive frequency of the vibrating plate portion 14, the acoustic velocity of air that passes through the pressure chamber 13, and the value of x when the Bessel function of the first kind $J_0(x)$ with respect to pressure oscillation is zero.

Although it is ideal that the pressure oscillation be brought into the resonant state as described above, some manufacturing tolerances and some temperature fluctuations occur in the drive frequency f and the dimensions of the vibrating plate portion 14, and thus, it can be said that a state in which pressure oscillation is within a certain range close to a resonant state is a quasi-ideal state of the pressure oscillation. Conditions under which pressure oscillation is brought into such a quasi-ideal state can be expressed by the following formula.

$$0.8\frac{k_0 c}{2\pi} \leqq a_2 f \leqq 1.2\frac{k_0 c}{2\pi} \quad \text{[Math. 5]}$$

In addition, conditions under which pressure oscillation is brought close to a further ideal state can be expressed in a limited manner by the following formula.

$$0.9\frac{k_0 c}{2\pi} \leqq a_2 f \leqq 1.1\frac{k_0 c}{2\pi} \quad \text{[Math. 6]}$$

When the drive frequency f of the vibrating plate portion 14 and the dimension a2 from the center of the pressure chamber 13 to the second inlet ports 35 are set such that these conditions expressed by [Math. 5] and [Math. 6] are satisfied, a quasi-ideal resonant state can be achieved in the pressure chamber 13, and the amplitude of pressure oscillation can be increased in a center portion of the pressure chamber 13.

Figure 6:
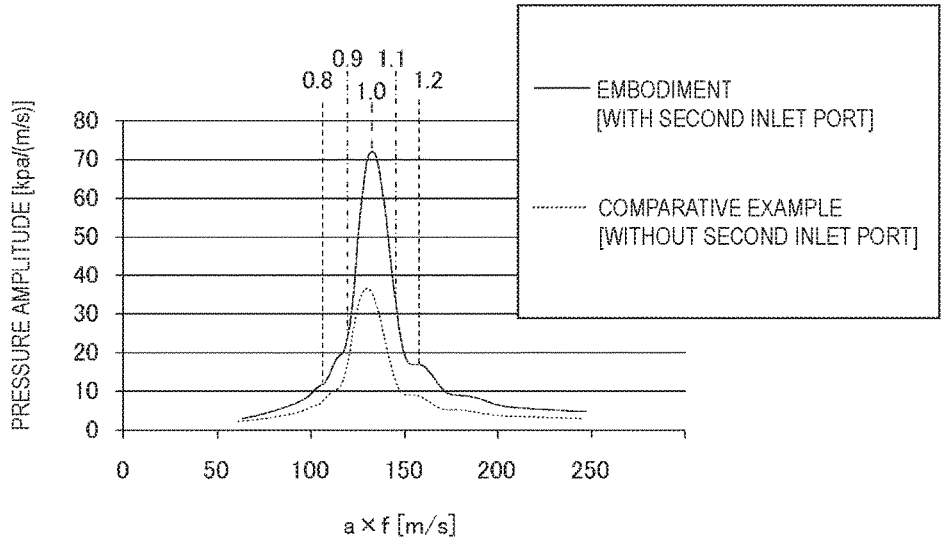
FIG. 6 is a graph illustrating conditions under which pressure oscillation in a pressure chamber is brought into a resonant state.

FIG. 6 is a graph illustrating the simulation results of the variations in the amplitude of pressure oscillation in the center portion of the pressure chamber 13 when [a2×f] is varied under predetermined conditions. In FIG. 6, a graph that corresponds to an example according to the present embodiment is indicated by a solid line, and a graph that corresponds to a comparative example in which a second inlet port is not provided is indicated by a dotted line. In addition, on the horizontal axis in FIG. 6, the positions of values, each of the values being obtained by multiplying $[(k_0 \times c)/2\pi]$ by a corresponding one of the coefficients 0.8, 0.9, 1.0, 1.1, and 1.2 shown in the above [Math. 4] to [Math. 6], are illustrated as additional notes.

In the relationship between [a2×f] and the amplitude of pressure oscillation according to the example, the amplitude of pressure oscillation becomes maximum in a state where [a2×f] satisfies the relationship of [Math. 4]. In a state where [a2×f] satisfies the relationship of [Math. 5], the amplitude of pressure oscillation is within a range of a sharp rise to a peak including the maximum value and a sharp fall from the peak and is appreciably large. In a state where [a2×f] satisfies the relationship of [Math. 6], the amplitude of pressure oscillation is within a range of a gentle rise to a gentle fall in the vicinity of the peak including the maximum value and is reasonably large. Therefore, by setting the drive frequency of the vibrating plate portion 14 and the dimension a2 from the center of the pressure chamber 13 to the second inlet ports 35 such that the conditions expressed by the above [Math. 4] to [Math. 6] are satisfied, the pump 10 can cause the pressure chamber 13 to perform pressure oscillation in a resonant state or in a quasi-ideal state close to the resonant state, and high discharge performance can be obtained.

In contrast, in the relationship between [a2×f] and the amplitude of pressure oscillation according to the comparative example, the maximum value of the amplitude of pressure oscillation is significantly smaller than that in the example. In addition, in the comparative example, the range of [a2×f] in which the amplitude of pressure oscillation at a certain level (e.g., 10 kPa or greater) is obtained is significantly smaller than that in the example.

Therefore, it is understood that, in the case where the first inlet ports and the second inlet ports are provided as in the example, the flow path resistance at each of the inlet ports is reduced, so that the amplitude of pressure oscillation can be increased, whereas in the case where only a first inlet port is provided without providing a second inlet port as in the comparative example, the flow path resistance at the inlet port will not be reduced, so that the amplitude of pressure oscillation will not be increased. The same applies to the case where there are variations in the drive frequency and the dimension due to manufacturing tolerances and temperature fluctuations, and it is understood that, in the example, a larger amplitude of pressure oscillation can be obtained with higher certainty compared with the comparative example.

In addition, it is desirable that the drive frequency f of the vibrating plate portion 14, which forms a part of the above-mentioned [a2×f] be approximately equal to a certain degree of the structural resonant frequency of the vibrating plate portion 14 (e.g., the first degree structural resonant frequency, the second degree structural resonant frequency, the third degree structural resonant frequency, or the like), and it is desirable that the dimension a2 from the center of the pressure chamber 13 to the second inlet ports 35 be set in accordance with the drive frequency f. By setting the drive frequency f of the vibrating plate portion 14 and the dimension a2 from the center of the pressure chamber 13 to the second inlet ports 35 in the manner described above, the amplitude of vibration of the vibrating plate portion 14 near the center of the pressure chamber 13 can be increased, and a higher discharge pressure and a higher discharge flow rate can be achieved in the pump 10.

In addition, it is desirable that the drive frequency f of the vibrating plate portion 14 be set to be approximately equal to the structural resonant frequency in a certain degree at which an amplitude profile of displacement vibration that occurs at each point from the center of the vibrating plate portion 14 to an outer peripheral portion of the vibrating plate portion 14 most closely approximates the following formula.

$$u(r) = J_0\left(\frac{k_0 r}{a_2}\right) \quad \text{[Math. 7]}$$

Here, r and u(r) respectively stand for a distance from the center of the pressure chamber 13 and the amplitude of pressure oscillation at the distance r. Note that, here, a state in which the amplitude profiles most closely approximate each other is defined as a state in which the position of an oscillation node adjacent to the center of the pressure chamber 13 in one of the profiles and the position of an oscillation node adjacent to the center of the pressure chamber 13 in the other profile are closest to each other.

When setting the drive frequency f of the vibrating plate portion 14 in the manner described above, the amplitude profile of the displacement vibration that occurs at each point from the center of the vibrating plate portion 14 to the outer peripheral portion of the vibrating plate portion 14 can be brought close to the amplitude profile of pressure oscillation that occurs in the pressure chamber 13. As a result, the vibrational energy of the vibrating plate portion 14 can be transmitted to the fluid in the pressure chamber 13 with only a small deterioration in the vibrational energy. Accordingly, in the pump 10, a higher discharge pressure and a higher discharge flow rate can be achieved.

In addition, in the pump 10, by setting the dimension a2 from the center of the pressure chamber 13 to the second inlet ports 35 to be smaller than the dimension a1 from the center of the pressure chamber 13 to the first inlet ports 34, the resonant frequency (resonance frequency) of pressure oscillation can be shifted to a higher frequency. This can make the sound generated when driving the pump 10 less audible to a person.

Figure 7:
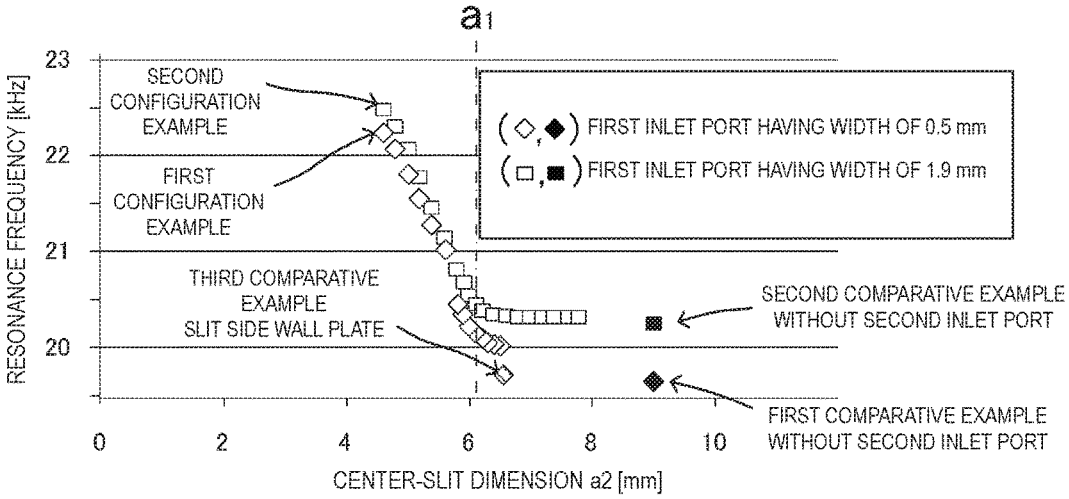
FIG. 7 is a graph illustrating variations in a frequency at which pressure oscillation in the pressure chamber is brought into the resonant state.

The resonant frequency (resonance frequency) of pressure oscillation will now be specifically described with reference to FIG. 7. FIG. 7 is a graph illustrating the simulation results of the variations in the resonance frequency of the pressure chamber 13 when the dimension a2 from the center of the pressure chamber 13 to the second inlet ports 35 is varied under predetermined conditions. In FIG. 7, as configuration examples according to the present embodiment, a first configuration example and a second configuration example are each indicated by an outlined legend symbol. The size (dimension in the radial direction) of each of the first inlet ports 34 formed in the vibrating plate portion in the first configuration example is different from that in the second configuration example. As comparative examples in each of which the second inlet ports (slits) are not provided, a first comparative example and a second comparative example are each indicated by a solid legend symbol. The size (dimension in the radial direction) of each of the first inlet ports 34 formed in the vibrating plate portion in the first comparative example is different from that in the second comparative example. A third comparative example in which a slit is formed in the side wall plate instead of the second inlet ports (slit) is indicated by a hatched legend symbol. Note that, in each of the configurations, a dimension a1 from the center of each of the first inlet ports 34 formed in the vibrating plate portion is set to about 6.1 mm.

First, two examples (the first configuration example and the second configuration example) according to the present embodiment will be described. In each of the examples, in the case where the dimension a2 from the center of the pressure chamber 13 to the second inlet ports 35 is larger than the dimension a1 from the center of the pressure chamber 13 to the first inlet ports 34, there are only small variations in the resonance frequency of the pressure chamber 13 when the dimension a2 is varied. In contrast, in the case where the dimension a2 from the center of the pressure chamber 13 to the second inlet ports 35 is smaller than the dimension a1 from the center of the pressure chamber 13 to the first inlet ports 34, the resonance frequency of the pressure chamber 13 is more likely to be shifted to a higher frequency as the dimension a2 becomes smaller. Therefore, in the pump 10 according to the present embodiment, by setting the dimension a2 from the center of the pressure chamber 13 to the second inlet ports 35 to be smaller than the dimension a1 from the center of the pressure chamber 13 to the first inlet ports 34, the resonance frequency of the pressure chamber 13 can be increased, and the sound generated when driving the pump 10 can be made less audible to a person.

When comparing two examples (the first configuration example and the first comparative example), in each of which the size of each of the first inlet ports 34 is small, the resonance frequency in the example according to the present embodiment (the first configuration example) is higher than that in the example according to the comparative example (the first comparative example). It is understood from this fact that, in the case where the size of each of the first inlet ports is small, the resonance frequency can be increased by only providing the second inlet ports as in the present embodiment.

In contrast, when comparing two examples (the second configuration example and the second comparative example), in each of which the size of each of the first inlet ports 34 is large, in the case where the second inlet ports 35 are positioned further inside than the first inlet ports 34, the resonance frequency in the example according to the present embodiment (the second configuration example) can be higher than that in the example according to the comparative example (the second comparative example). However, in the case where the second inlet ports 35 are positioned further outside than the first inlet ports 34, there was no significant difference in the resonance frequency between the two examples.

It is understood from these facts that, by at least positioning the second inlet ports 35 so as to be closer to the center of the pressure chamber 13 than the first inlet ports 34 are, the resonance frequency of the pressure chamber 13 can be increased regardless of the size of each of the first inlet ports 34 and that, in the case where the size of each of the first inlet ports 34 is small, the resonance frequency of the pressure chamber 13 can be increased by providing the second inlet ports 35 at any positions. Note that, although the third comparative example is a case in which a slit is formed in the side wall plate instead of the second inlet ports 35, the resonance frequency of the pressure chamber 13 cannot be increased by simply forming the slit in the side wall plate.

As described above, in the pump 10 according to the first embodiment of the present disclosure, by forming the first inlet ports 34 in the vibrating plate portion 14 and forming the second inlet ports 35 in the top plate portion 15, the flow path resistance at each of the first inlet ports 34 and at each of the second inlet ports 35 can be reduced, and as a result, the discharge performance can be further improved compared with the related art. In addition, according to the pump 10, the resonance frequency in the pressure chamber 13 can be shifted to a higher frequency, and the sound generated when driving the pump 10 can be made less audible to a person.

Figure 8:
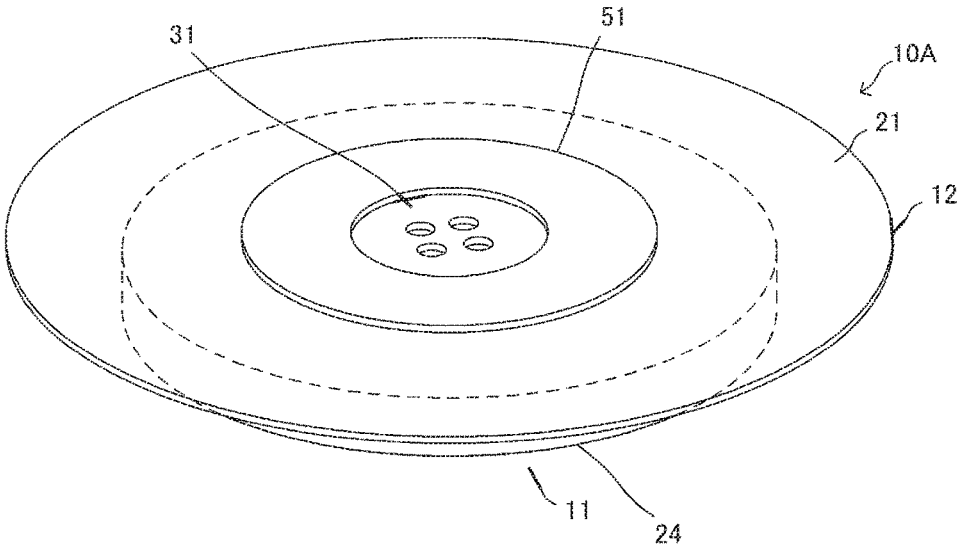
FIG. 8 is an external perspective view of a pump according to a modification of the present disclosure when viewed from the top surface side of the pump.
Figure 9:
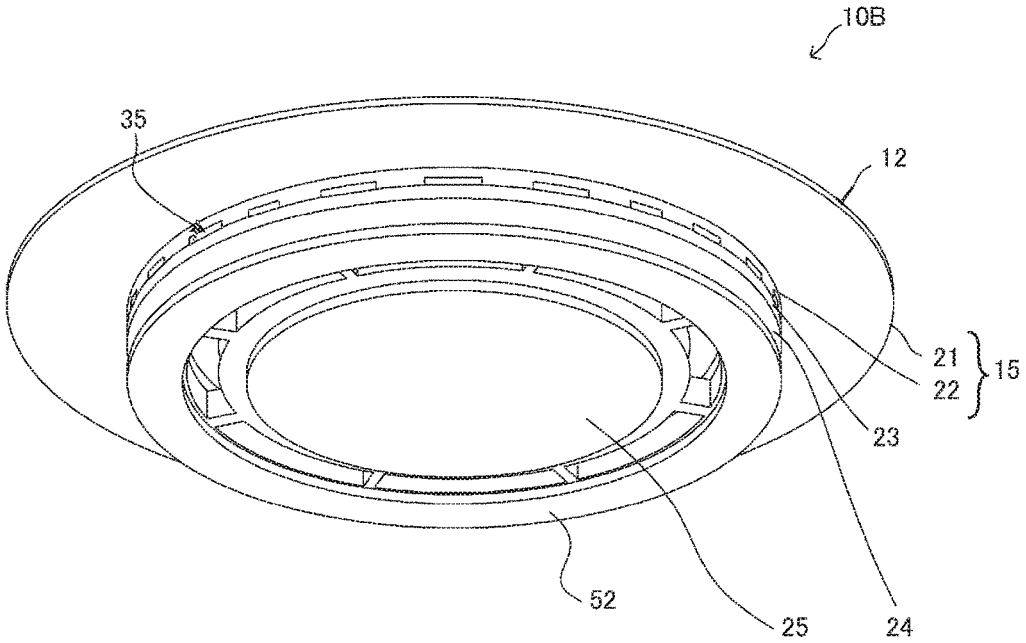
FIG. 9 is an external perspective view of a pump according to another modification of the present disclosure when viewed from the bottom surface side of the pump.

Note that, in the present embodiment, although a configuration example has been described in which only the piezoelectric element 25 is provided on the bottom surface side of the vibrating plate portion 14 and in which the bottom surface of the vibrating plate portion 14 excluding the piezoelectric element 25 is formed so as to be substantially flat, a reinforcing plate having a suitable shape may be provided on the bottom surface side of the vibrating plate portion 14. In addition, a reinforcing plate having a suitable shape may also be provided on the top surface side of the top plate portion 15. By providing reinforcing plates each having an appropriate shape, the amplitude profile of displacement vibration that occurs between the center of the vibrating plate portion 14 and the outer peripheral portion of the vibrating plate portion 14 and the amplitude profile of pressure oscillation that occurs between the center of the pressure chamber 13 and the outer peripheral portion of the pressure chamber 13 can be adjusted and brought close to each other. For example, as in a pump 10A according to a first modification that is illustrated in FIG. 8, a reinforcing plate 51 having a circular plate-like shape may be provided on the top surface of the top plate portion 15 so as to cover the periphery of the outlet ports 31, so that the amplitude profile of pressure oscillation of the pressure chamber 13 can be adjusted with only a small influence on the amplitude profile of displacement vibration of the vibrating plate portion 14, and these amplitude profiles can be brought close to each other. Alternatively, as in a pump 10B according to a second modification that is illustrated in FIG. 9, a reinforcing plate 52 having a ring-like shape may be provided on the bottom surface of the vibrating plate portion 14 so as to cover the periphery of a diaphragm, so that the amplitude profile of displacement vibration of the vibrating plate portion 14 and the amplitude profile of pressure oscillation of the pressure chamber 13 can be affected so as to be brought closer to each other. By bringing the amplitude profile of displacement vibration of the vibrating plate portion 14 and the amplitude profile of pressure oscillation of the pressure chamber 13 close to each other in the manner described above, the vibrational energy of the vibrating plate portion 14 can be transmitted to the fluid in the pressure chamber 13 with only a small deterioration in the vibrational energy, and a higher discharge pressure and a higher discharge flow rate can be achieved.

In addition, in the present embodiment, a configuration example has been described in which the dimension a2 from the center of the pressure chamber 13 to the second inlet ports 35 is set to be smaller than the dimension a1 from the center of the pressure chamber 13 to the first inlet ports 34. Contrary to this, however, according to the present disclosure, the dimension a2 may be set to be larger than the dimension a1.

Second Embodiment

Figure 10:
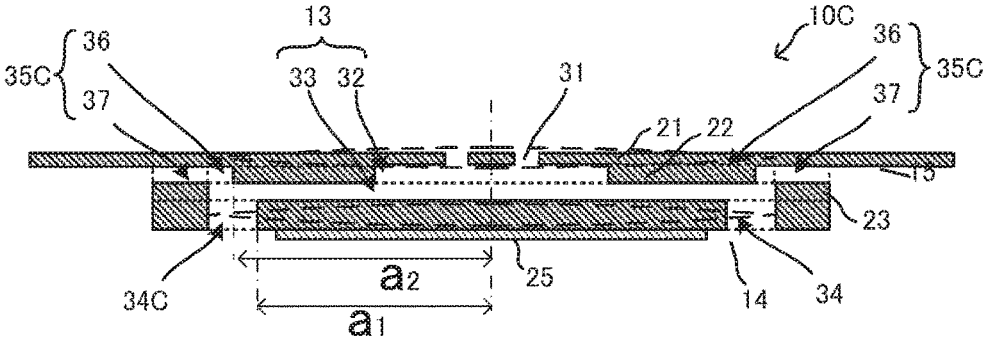
FIG. 10 is a cross-sectional side view of a pump according to a second embodiment of the present disclosure.

FIG. 10 is a cross-sectional side view of a pump 10C according to a second embodiment of the present disclosure.

In the pump 10C, second inlet ports 35C are positioned to be closer to the outer periphery of the pressure chamber 13 than first inlet ports 34C are.

Similar to the first embodiment, the pump 10C, which is configured as described above, has not only the first inlet ports 34C but also the second inlet ports 35C, and thus, even if the size of each of the first inlet ports 34C is small, the total flow rate of the fluid flowing through the first inlet ports 34C and the fluid flowing through the second inlet ports 35C can be large, and the flow path resistance at each of the first inlet ports 34C and at each of the second inlet ports 35C can be reduced. Therefore, the viscosity loss of the fluid can be reduced without increasing the size of each of the first inlet ports 34C, and the pump 10C can obtain discharge performance better than that in the related art.

However, in the present embodiment, the dimension a2 from the center of the pressure chamber 13 to the second inlet ports 35C is larger than the dimension a1 from the center of the pressure chamber 13 to the first inlet ports 34C, and thus, the conditions under which pressure oscillation is brought into an ideal resonant state can be expressed by the following formula by not using the dimension a2 from the center of the pressure chamber 13 to the second inlet ports 35C but using the dimension a1 from the center of the pressure chamber 13 to the first inlet ports 34C.

$$a_1 f = \frac{k_0 c}{2\pi} \quad \text{[Math. 8]}$$

Accordingly, in the present embodiment, conditions under which pressure oscillation is brought into a quasi-ideal resonant state can be expressed by the following formula.

$$0.8\frac{k_0 c}{2\pi} \leqq a_1 f \leqq 1.2\frac{k_0 c}{2\pi} \quad \text{[Math. 9]}$$

In addition, conditions under which pressure oscillation is brought close to a further ideal state can be expressed in a further limited manner by the following formula.

$$0.9\frac{k_0 c}{2\pi} \leqq a_1 f \leqq 1.1\frac{k_0 c}{2\pi} \quad \text{[Math. 10]}$$

If the drive frequency f of the vibrating plate portion 14 and the dimension a1 from the center of the vibrating plate portion 14 to the first inlet ports 34C are set such that the conditions expressed by [Math. 9] or [Math. 10] are satisfied, an ideal resonant state, which is second only to that in the first embodiment, can be achieved in the pressure chamber 13, and the amplitude of pressure oscillation can be increased in the center portion of the pressure chamber 13.

In addition, in the present embodiment, it is desirable that the drive frequency f of the vibrating plate portion 14 be set to be approximately equal to the structural resonant frequency in a certain degree at which an amplitude profile of displacement vibration that occurs at each point from the center of the vibrating plate portion 14 to the outer peripheral portion of the vibrating plate portion 14 most closely approximates the following formula.

$$u(r) = J_0\left(\frac{k_0 r}{a_1}\right) \quad \text{[Math. 11]}$$

In the present embodiment, by setting the drive frequency f of the vibrating plate portion 14 as described above, the vibrational energy of the vibrating plate portion 14 can be transmitted to the fluid in the pressure chamber 13 with only a small deterioration in the vibrational energy, and a higher discharge pressure and a higher discharge flow rate can be achieved as has been expected.

Note that, in each of the above-described embodiments, although an example has been described in which each of the second inlet ports is formed in a groove shape, according to the present disclosure, the second inlet ports may have other shapes.

Third Embodiment

Figure 11:
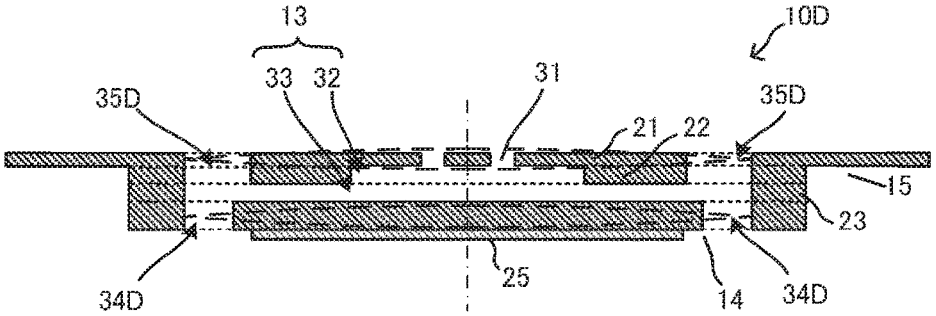
FIG. 11 is a cross-sectional side view of a pump according to a third embodiment of the present disclosure.

FIG. 11 is a cross-sectional side view of a pump 10D according to a third embodiment of the present disclosure.

The pump 10D is a configuration example in which second inlet ports 35D are each formed in a hole shape extending through the top plate portion 15. Note that, similar to the first embodiment, the dimension a2 from the center of the pressure chamber 13 to the second inlet ports 35D is set to be smaller than the dimension a1 from the center of the pressure chamber 13 to the first inlet ports 34D.

Similar to the first embodiment, the pump 10D, which is configured as described above, has not only the first inlet ports 34D but also the second inlet ports 35D, and thus, the flow path resistance at each of the first inlet ports 34D and at each of the second inlet ports 35D can be reduced. Therefore, the viscosity loss of the fluid can be reduced without increasing the size of each of the first inlet ports 34D, and also the pump 10 can obtain discharge performance better than that in the related art. In addition, also in the pump 10D, as has been expected, the resonance frequency in the pressure chamber can be shifted to a higher frequency, and the sound generated when driving the pump 10D can be made less audible to a person.

However, in the pump 10D, which is configured as described above, the rigidity of the top plate portion 15 is low, and thus, there is a possibility that the top plate portion 15 will be likely to become damaged or that unnecessary vibration will be likely to occur in the top plate portion 15. Therefore, from these standpoints, it is preferable that each of the second inlet ports be formed in a groove shape extending along the bottom surface of the top plate portion as in the configurations according to the first and second embodiments.

Fourth Embodiment

Figure 12:
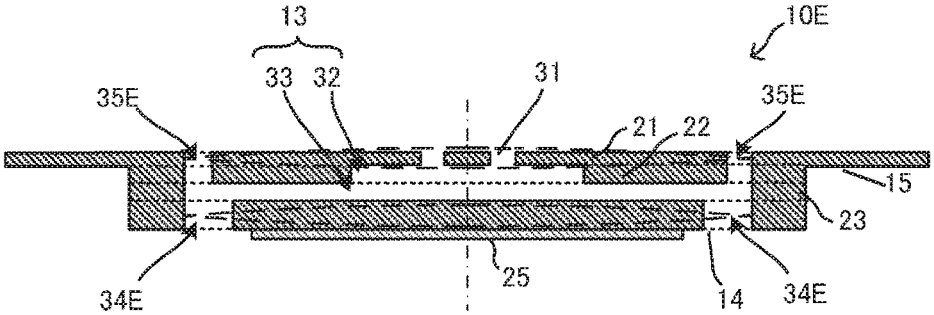
FIG. 12 is a cross-sectional side view of a pump according to a fourth embodiment of the present disclosure.

FIG. 12 is a cross-sectional side view of a pump 10E according to a fourth embodiment of the present disclosure.

Similar to the third embodiment, the pump 10E has second inlet ports 35E each of which is formed in a hole shape extending through the top plate portion 15. Note that, in the pump 10E, similar to the second embodiment, the dimension a2 from the center of the pressure chamber 13 to the second inlet ports 35E is set to be larger than the dimension a1 from the center of the pressure chamber 13 to the first inlet ports 34E.

Also in the pump 10E, which is configured as described above, the flow path resistance at each of the first inlet ports 34E and at each of the second inlet ports 35E can be reduced, and discharge performance better than that in the related art can be obtained.

Although the present disclosure can be implemented as described in the above embodiments and modifications, suitable modifications may be made to the above-described configurations within the scope of the present disclosure as described in the claims.

Figure 13:
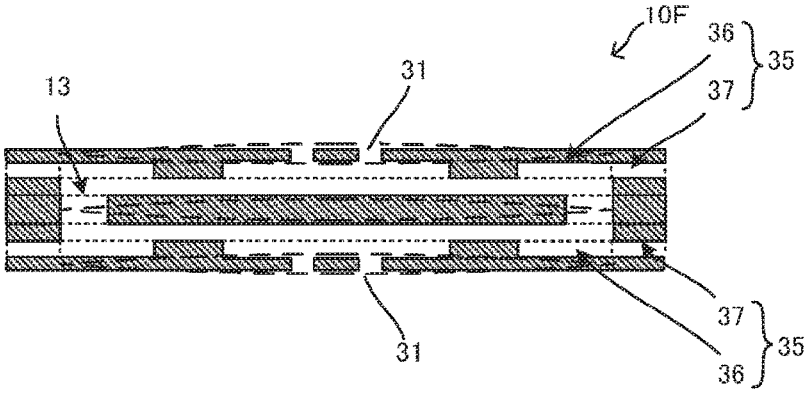
FIG. 13 is a cross-sectional side view of a pump according to another modification of the present disclosure.

For example, as in a pump 10F according to a third modification that is illustrated in FIG. 13, the configuration formed of the side wall plate and the top plate portion according to the first embodiment may be provided on both sides of the vibrating plate portion. In this case, outlet ports through which the fluid is discharged from the pressure chamber can be provided on the top surface side and the bottom surface side of the pump 10F. In addition, a two-sided discharge structure such as that described above is not limited to being employed in the first embodiment and may also be employed in the second to fourth embodiments.

In each of the above-described embodiments, although a case has been described in which the diaphragm is driven by the piezoelectric element, the pump can be configured by using a different driving source that causes the diaphragm to perform a pumping operation as a result of being electromagnetically driven. In addition, in the case of using a piezoelectric element, a piezoelectric material other than a PZT-based ceramic may be used. For example, the piezoelectric element can be made of a non-lead-based piezoelectric ceramic, such as a potassium-sodium niobate-based ceramic or an alkali niobate-based ceramic, or the like.

In each of the above-described embodiments, although a case has been described in which the piezoelectric element is driven at the structural resonant frequency in a suitable degree of the vibrating plate portion, the present disclosure is not limited to this configuration. For example, the drive frequency of the piezoelectric element may be different from the structural resonant frequency of the vibrating plate portion.

In each of the above-described embodiments, although a case has been described in which the piezoelectric element is joined to a main surface of the vibrating plate, the main surface being located on the side opposite to the side on which the pressure chamber is present, the present disclosure is not limited to this configuration. For example, the piezoelectric element may be joined to another main surface of the vibrating plate, the other main surface being located on the side on which the pressure chamber is present, or two piezoelectric elements may be joined to the two main surfaces of the vibrating plate.

In each of the above-described embodiments, although a case has been described in which a valve is not provided in each of the inlet and outlet ports, a valve may be provided in one of the inlet and outlet ports, or valves may be provided in all the inlet and outlet ports.

In each of the above-described embodiments, although a configuration example has been described in which the pump includes the projecting portion that projects from the main body portion in the radial direction, the projecting portion does not need to be provided, and each of the pumps may be formed so as to have a simple cylindrical shape. In addition, each of the pumps is not limited to having a cylindrical shape and may be formed so as to have a suitable external shape such as a polygonal shape or an elliptical columnar shape.

In the above-described embodiments, although a case has been described in which, in the pressure chamber, a recess is formed in the vicinity of a flow path hole on the side on which the top plate portion is present, the present disclosure is not limited to this configuration, and a recess does not need to be provided.

In the above-described embodiments, although a case has been described in which the top plate portion is formed as the multilayer body formed of the thin top plate and the thick top plate, the present disclosure is not limited to this configuration. For example, the top plate portion having the above-mentioned shape may be formed of an integrated member. Alternatively, the top plate portion may be formed such that the thickness of the entire top plate portion is uniform.

Lastly, the descriptions of the above-described embodiments are examples in all respects, and the present disclosure is not to be considered limited to the embodiments. The scope of the present disclosure is to be determined not by the above-described embodiments, but by the claims. In addition, the scope of the present disclosure includes a range equivalent to the claims.

10, 10A, 10B, 10C, 10D, 10E pump
11 main body portion
12 projecting portion
13 pressure chamber
14 vibrating plate portion
15 top plate portion
21 thin top plate
22 thick top plate
23 side wall plate
24 vibrating plate
25 piezoelectric element
31 outlet port
32, 33 cavity
34, 34C, 34D, 34E first inlet port
35, 35C, 35D, 35E second inlet port
36 larger width portion
37 smaller width portion
41 frame portion
42 diaphragm
43 connecting portion
51 reinforcing plate
52 reinforcing plate

The invention claimed is:

1. A pump including a pressure chamber generating a pressure oscillation occurring from a center portion of the pressure chamber to an outer peripheral portion of the pressure chamber when viewed in a plan view in a thickness direction, the pump comprising:

a vibrating plate portion facing the pressure chamber in the thickness direction and displaced in the thickness direction; and a top plate portion facing the pressure chamber in a direction opposite to the thickness direction in which the vibrating plate portion faces the pressure chamber, wherein the vibrating plate portion has a first inlet port opened at the outer peripheral portion of the pressure chamber, and wherein the top plate portion has an outlet port opened at the center portion of the pressure chamber and a second inlet port opened at the outer peripheral portion of the pressure chamber.

2. The pump according to claim 1, wherein a formula shown below is satisfied:

$$0.8\times\frac{k_0c}{2\pi}<a*f<1.2\times\frac{k_0c}{2\pi} \quad \text{[Math. 1]}$$

where a, f, c, and $K_0$ respectively stand for one of a dimension from a center of the top plate portion to the second inlet port and a dimension from a center of the vibrating plate portion to the first inlet port, the one of the dimensions being smaller than another one of the dimensions, a resonant frequency of the vibrating plate portion, an acoustic velocity of a fluid passing through the pressure chamber, and a value satisfying the Bessel function of the first kind $J_0(k_0)=0$.

3. The pump according to claim 2, wherein a formula shown below is satisfied:

$$0.9\times\frac{k_0c}{2\pi}<a*f<1.1\times\frac{k_0c}{2\pi}. \quad \text{[Math. 2]}$$

4. The pump according to claim 2, wherein the dimension from the center of the top plate portion to the second inlet port is smaller than the dimension from the center of the vibrating plate portion to the first inlet port.

5. The pump according to claim 1, wherein the second inlet port extends in a lateral direction perpendicular to the thickness direction of the top plate portion and communicates with an outside.

6. The pump according to claim 3, wherein the dimension from the center of the top plate portion to the second inlet port is smaller than the dimension from the center of the vibrating plate portion to the first inlet port.

7. The pump according to claim 2, wherein the second inlet port extends in a lateral direction perpendicular to the thickness direction of the top plate portion and communicates with an outside.

8. The pump according to claim 3, wherein the second inlet port extends in a lateral direction perpendicular to the thickness direction of the top plate portion and communicates with an outside.

9. The pump according to claim 4, wherein the second inlet port extends in a lateral direction perpendicular to the thickness direction of the top plate portion and communicates with an outside.

* * * * *